US005212953A

United States Patent [19]

Kawaguchi et al.

[11] Patent Number: 5,212,953

[45] Date of Patent: May 25, 1993

[54] APPARATUS FOR PREVENTING EVAPORATION OF LIQUEFIED GAS IN LIQUEFIED GAS RESERVOIR AND ITS CONTROL METHOD

[75] Inventors: Etsuji Kawaguchi; Masato Adachi, both of Moriyama; Masayuki Taira; Eiichi Watanabe, both of Akishima, all of Japan

[73] Assignees: Iwatani Sangyo Kabushiki Kaisha; Iwatani Plantech Kabushiki Kaisha, both of Osaka; Jeol Ltd., Tokyo, all of Japan

[21] Appl. No.: 759,904

[22] Filed: Sep. 13, 1991

[30] Foreign Application Priority Data

Feb. 8, 1991 [JP] Japan ..... 3-039291

[51] Int. Cl.[5] ..... F17C 5/02

[52] U.S. Cl. ..... 62/47.1; 62/51.1

[58] Field of Search ..... 62/47.1, 49.2, 51.1

[56] References Cited

U.S. PATENT DOCUMENTS 5,163,297 11/1992 Yami et al. ..... 62/47.1

*Primary Examiner*—John C. Fox

*Attorney, Agent, or Firm*—Foley & Lardner

[57] ABSTRACT

The present invention relates to an apparatus for preventing evaporation of liquefied gas in a liquefied gas reservoir used for cooling an energy dispersive spectrometer type X-ray detector (EDS detector) and its control method. A cold head of a cryogenic refrigerator is disposed in an upper opening of the liquefied gas reservoir, the cryogenic refrigerator is adapted to be put into automatic operation depending on temperature inside the liquefied gas reservoir, wherein the automatic operation mode of the cryogenic refrigerator is put into rest by remote control during the use of the EDS detector, while the cryogenic refrigerator is put into automatic operation with a previous alarm issued when the temperature inside the liquefied gas reservoir increases over a set temperature with the EDS detector being out of use, thereby allowing vaporized gas to be reliquefied with gas consumption reduced.

5 Claims, 6 Drawing Sheets

APPARATUS FOR PREVENTING EVAPORATION OF LIQUEFIED GAS IN LIQUEFIED GAS RESERVOIR AND ITS CONTROL METHOD

BACKGROUND OF THE INVENTION

The present invention relates to a liquefied gas anti-evaporating apparatus in a cooling system used for cooling an energy dispersive spectrometer type X-ray detector (EDS detector) with liquefied gas to provide an electron microscope with an element analysis function.

DESCRIPTION OF THE PRIOR ART

In general, an EDS detector is cooled with liquid nitrogen to improve the measuring accuracy thereof. This is conventionally accomplished by taking out a cold finger from the bottom wall of a reservoir which stores liquid nitrogen therein, and mounting and EDS detector on the cold finger to maintain the EDS detector at an ultra-low temperature by means of liquid nitrogen. In this case, however, there is a restriction that the EDS detector should maintain its low temperature once it has been attained. Since liquid nitrogen to be used for cooling the EDS detector will be scattered out of the reservoir through evaporation, it is necessary to compensate for this part of liquid nitrogen thus scattered to maintain the cooling temperature within a fixed range for a long period of time, which necessitate the operator to supply liquefied nitrogen to the liquefied gas reservoir frequently.

In the case of an electron microscope utilizing an EDS detector, the floor height on which the liquefied gas reservoir for cooling the EDS detector is disposed is restricted because of the irradiation axis of the electron microscope. That is, the liquefied gas replenishing port opened at the upper part of the liquefied gas reservoir will be situated as high as, for example, 1.5 m above the floor. This caused a problem that it was a troublesome job to supply liquid nitrogen to the liquefied nitrogen reservoir using a replenishing container such as a Dewar vessel.

To eliminate this problem, some of the present inventors provided a liquefied gas evaporation preventive apparatus which could save the liquid nitrogen replenishment work by providing the liquefied gas reservoir with a cryogenic refrigerator for condensing evaporating gas to maintain the amount of liquid nitrogen in the liquefied gas constant (Japanese Patent Laid-Open Publication No. HeI2-279977).

This apparatus was formed to have a construction in which a cold finger is taken out of the wall of a liquefied gas reservoir for connecting it to an EDS detector and a cold head of a cryogenic refrigerator is disposed at the upper opening of the liquefied gas reservoir. With this construction, the cryogenic refrigerator is operated and controlled based on the temperature within the liquefied gas reservoir, and vapor within the liquefied gas reservoir is condensed and liquefied by the chilling temperature produced at the cold head.

In the aforementioned conventional apparatus the cold head is supported on a stand through a horizontal one axis linear guide mechanism and the liquefied gas reservoir is suspended from this cold head. With this construction, however, although the cold head can follow the uniaxial retract movement of the EDS detector, when the vibration on the EDS detector side in two dimensional directions is transmitted, the cold head cannot follow this two dimensional movement to result in applying load to the cold finger lead-out portion and the cold head support.

In addition, in the conventional apparatus, the operation of the cryogenic refrigerator is automatically performed based on the temperature condition within the liquefied gas reservoir, and shutdown to resetting of this automatic operation is performed by a manual operation which could not be remotely controlled. Because of this, there is an inconvenience such that the operator has to leave his work table and stop an automatic operation of the cryogenic refrigerator during his work with an electron microscope or the like.

Furthermore, it is commonly practiced to suppress the generation of vibration during the observation work by an electron microscope as much as possible since slight vibration would hamper clear displays of images observed. In the conventional apparatus the cryogenic refrigerator will be automatically operated when the temperature within the liquefied gas reservoir reaches a specified level during measuring operation. This also causes a problem which greatly affects the accuracy of measuring operations.

It is therefore an object of the present invention to eliminate the above-mentioned problems by providing a liquefied gas anti-evaporating apparatus and its control method in a cooling liquefied gas reservoir by which the replenishment work of liquefied gas can be saved for a long period of time and in addition, the operator can perform his measuring operations at ease.

SUMMARY OF THE INVENTION

In accomplishing these and other objects, the apparatus of the present invention is characterized in that a cold head of a cryogenic refrigerator is supported on a stand with a horizontal biaxial linear guide mechanism interposed therebetween thereby allowing upper-limit and lower-limit liquid levels within a liquefied gas reservoir to be detected by a level gauge, and also temperature inside the liquefied gas reservoir to be detected by a temperature measuring instrument, and that a temperature signal inside the liquefied gas reservoir detected by the aforementioned temperature measuring instrument can be input into an operation control device for the refrigerator so that the cryogenic refrigerator will be controlled for automatic operation depending on actuation of temperature detection by the temperature measuring instrument.

Further, the method of the present invention is characterized in that a cold head of the cryogenic refrigerator can be controlled for automatic operation depending on temperature inside the liquefied gas reservoir and is switchable to release its automatic operation, wherein in the automatic operation control state the cryogenic refrigerator will be put into automatic operation by an increase in temperature inside the liquefied gas reservoir over a set temperature, while in the automatic operation released state the refrigerator can forcedly be switched into automatic operation control state when the temperature inside the liquefied gas reservoir reaches a specified temperature higher than the foregoing set one; a previous alarm for notifying forced automatic operation will be issued at a temperature higher than the automatic operation starting temperature and lower than the aforementioned forced automatic operation switching set temperature; and that the switching operation between the automatic operation control state and the automatic operation released state as well as the previous alarm can be reset by operation of a resetting device, in which the reset operation can be remotely controlled.

According to the apparatus of the present invention, the cold head of the cryogenic refrigerator is supported on the stand with the horizontal biaxial linear guide mechanism interposed therebetween, thereby allowing upper-limit and lower-limit liquid levels within the liquefied gas reservoir to be detected by the level gauge, and also temperature inside the liquefied gas reservoir can be detected by the temperature measuring instrument. And since a temperature signal inside the liquefied gas reservoir detected by the aforementioned temperature measuring instrument can be input into the operation control device for the refrigerator so that the cryogenic refrigerator will be controlled for automatic operation depending on actuation of temperature detection by the temperature measuring instrument, the lead-out portion of the cold finger and the support portion for the cold head will never be burdened, the cold head being capable of freely following its two-dimensional movement.

Further, according to the method of the present invention, since the cold head of the cryogenic refrigerator can be controlled for automatic operation depending on temperature inside the liquefied gas reservoir and is switchable to release its automatic operation, in the automatic operation control state the cryogenic refrigerator will be put into automatic operation by an increase in temperature inside the liquefied gas reservoir over a set temperature, while in the automatic operation released state the refrigerator can forcedly be switched into the automatic operation control state when the temperature inside the liquefied gas reservoir reaches a specified temperature higher than the foregoing set one. A previous alarm for notifying forced automatic operation will be issued at a temperature higher than the set one for starting the automatic operation and lower than the aforementioned set one for switching into forced automatic operation. And the switching operation between the automatic operation control state and the automatic operation released state as well as the previous alarm can be reset by operation of a resetting device, in which the reset operation can be remotely controlled, and therefore an operator can perform the switching operation between the automatic operation control state and the automatic operation released state of the cryogenic refrigerator without leaving his work table. This can reduce his task.

In addition, since the present invention is so arranged that the previous alarm for notifying forced automatic operation will be issued before temperature inside the liquefied gas reservoir reaches the set one for starting forced automatic operation during any work with an electron microscope with the automatic operation of the cryogenic refrigerator released, it is possible to readily suppress generation of vibrations caused by unexpected actuation of the cryogenic refrigerator during measurement, thus allowing the measuring accuracy by the electron microscope to be maintained at a high level.

BRIEF DESCRIPTION OF THE DRAWINGS

These and other objects and features for the present invention will become apparent from the following description taken in conjunction with the preferred embodiment thereof with reference to the accompanying drawings, in which.

DETAILED DESCRIPTION OF THE PREFERRED EMBODIMENT

Figure 1A:
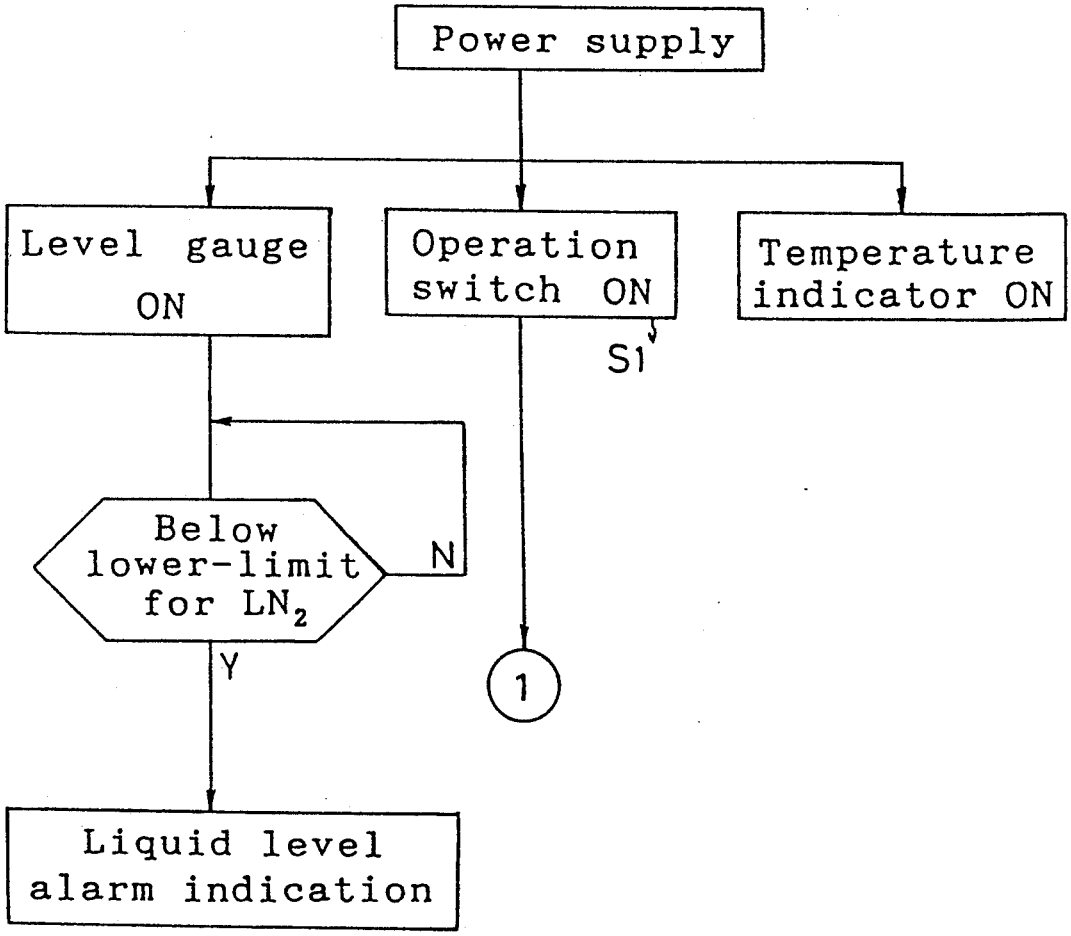
FIG. 1 is a flow chart of controlling the cryogenic refrigerator.

A liquefied gas anti-evaporating apparatus 1 here mentioned comprises a cold finger 7 supporting an EDS detector 6 in a scanning type electron microscope, a liquefied gas reservoir 4 connected to one end thereof, and a cold head 12 of a cryogenic refrigerator 11 disposed above the liquefied gas reservoir 4. The liquefied gas reservoir 4 is formed of an adiabatic vessel and has a liquefied gas for refrigerant such as liquid nitrogen stored therein.

The cryogenic refrigerator 11 comprises the cold head 12 and a compressor unit 13, the cold head 12 being supported on the upper end of a stand 3 provided upright on the floor 2 in correspondence with an upper end opening 10 of the liquefied gas reservoir 4, and the compressor unit 13 is mounted on the floor 2 preventively of vibrations. Further, the compressor unit 13 and the cold head 12 are coupled and communicated with each other using two flexible tubes 14, so that a cryogenically low temperature can be obtained by adiabatically expanding the gaseous refrigerant such as helium compressed by the compressor unit 13 in the interior of the cold head 12.

A cold end 15 of the cold head 12 is protruded from the upper end opening 10 into the interior of the above-mentioned liquefied gas reservoir 4 so as to allow refrigerant liquefied gas vaporized in the liquefied gas reservoir 4 to be condensed by the coldness generated at the portion of the cold end 15 so as to be reliquefied.

In addition, there is provided bellows 16 as a vibration-preventing support between the cold head 12 and the liquefied gas reservoir 4 so that vibrations involved in operation of the cryogenic refrigerator 11 will not transfer to the liquefied gas reservoir 4. Also, to enable the cold head 12 to move after the retract of the EDS detector, the cold head 12 is mounted on the stand 3 with the horizontal biaxial linear guide mechanism 8 interposed therebetween in such a manner that the cold head 12 is horizontally movable in the back and forth, right and left directions.

The above-described cryogenic refrigerator 11 is adapted to be automatically operated depending on temperature inside the liquefied gas reservoir 4. More specifically, atmospheric and liquid temperatures inside the liquefied gas reservoir 4 are detected by a temperature measuring instrument 17 such as a thermocouple or vapor-pressure thermometer. Then a detected temperature signal based on a temperature detected by the temperature measuring instrument 17 is input into an operation control device 19 for the cryogenic refrigerator 11 through a temperature indicator 18, and operation of the compressor unit 13 is controlled depending on an output signal from the operation control device 19. In this arrangement, when the internal temperature of the liquefied gas reservoir 4 reaches a specified high temperature, the cryogenic refrigerator 11 will start its operation, while when it reaches a specified low temperature, the operation will be stopped.

The reference values for the operation control mentioned above are set, for example, to 71 K. for the high-temperature reference value and 70 K. for the low-temperature one in the case where the liquefied gas stored in the liquefied gas reservoir is liquid nitrogen. The setting 71 K. for the high-temperature reference value is based on the fact that liquid nitrogen takes about 8 hours or more to reach 77.34 K., boiling point at one atmospheric pressure with the cryogenic refrigerator 11 out of operation, because even slight vibrations should be avoided in the operation of the EDS detector and therefore the cryogenic refrigerator 11 is made out of its automatic operation function and kept non-operated during the detection work.

Furthermore, to notify the time for resupplying liquid nitrogen to the liquefied gas reservoir 4, there is provided a level gauge 20 of two-point type for detecting lower-limit and upper-limit liquid levels, which extends into the interior of the liquefied gas reservoir 4. Detection of lower-limit and upper-limit liquid levels by the level gauge 20 tells the time for resupplying liquid nitrogen, and moreover allows liquid nitrogen to be resupplied without removing the cold head 12.

In the drawings, reference numeral 21 denotes a safety valve for preventing gas pressure inside the liquefied gas reservoir 4 from increasing over a specified pressure. Numeral 22 denotes a pressure gauge for indicating the pressure inside the liquefied gas reservoir 4. Numeral 23 denotes a gas lead-in passage for resupplying refrigerant gas in its gaseous state into the liquefied gas reservoir 4. And numeral 24 denotes a gas supply control valve intervenient in the gas lead-in passage 23.

The operation control device 19 and the work for resupplying liquefied gas are adapted so as to be controlled remotely from the operation table of an electron microscope, not illustrated.

Figure 1:
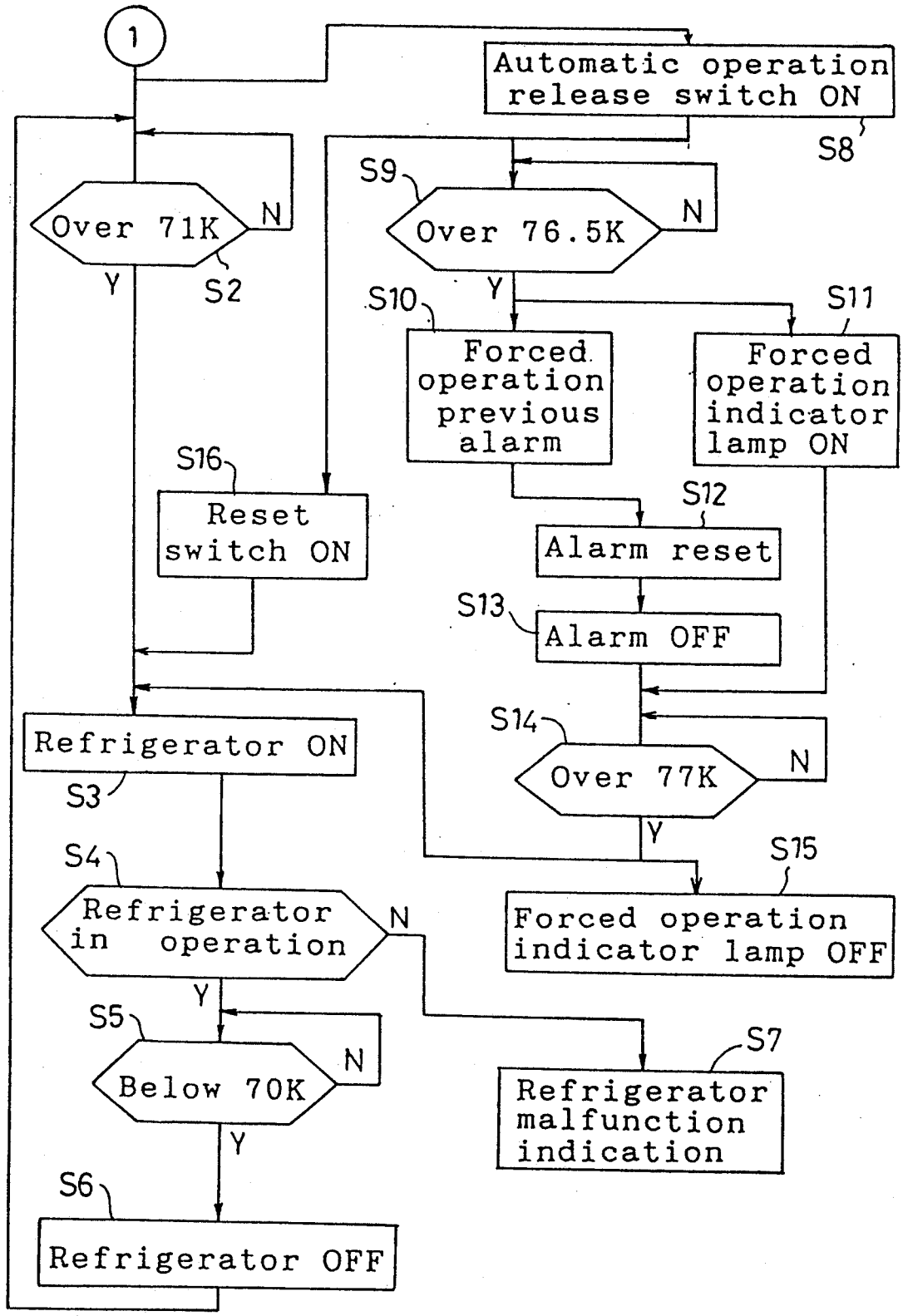
Figure 2:
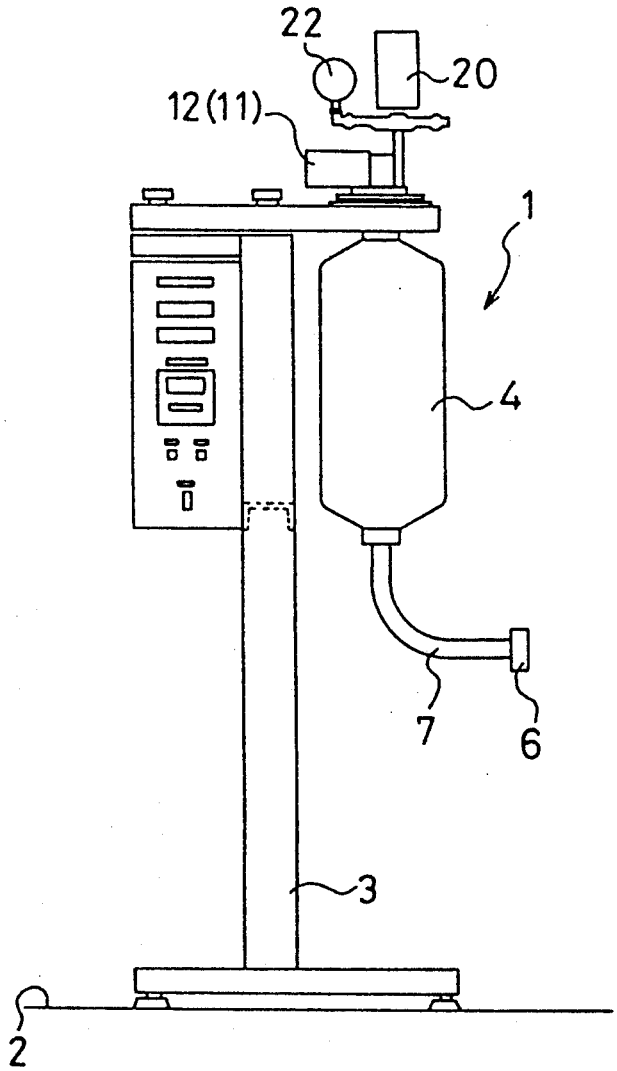
FIG. 2 is a schematic construction view of the liquefied gas anti-evaporating apparatus.
Figure 3:
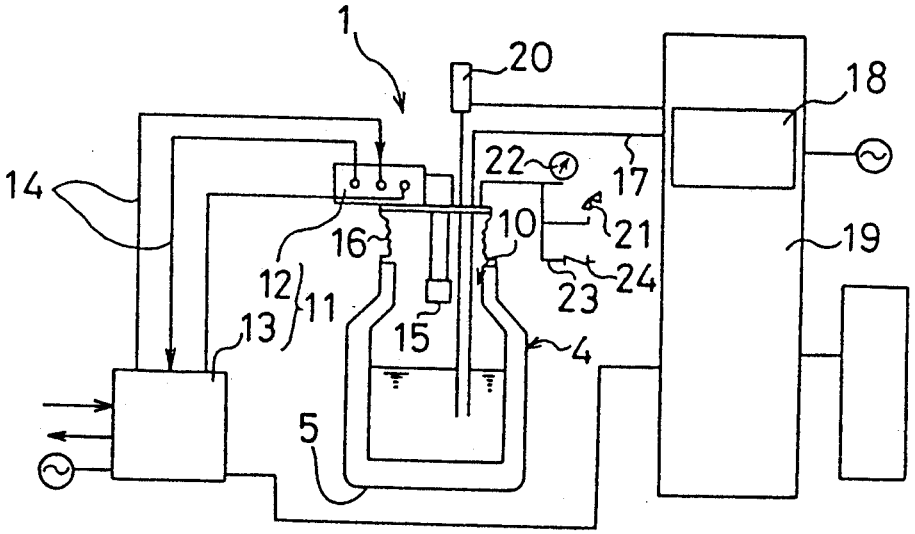
FIG. 3 is a side view of the same.
Figure 4:
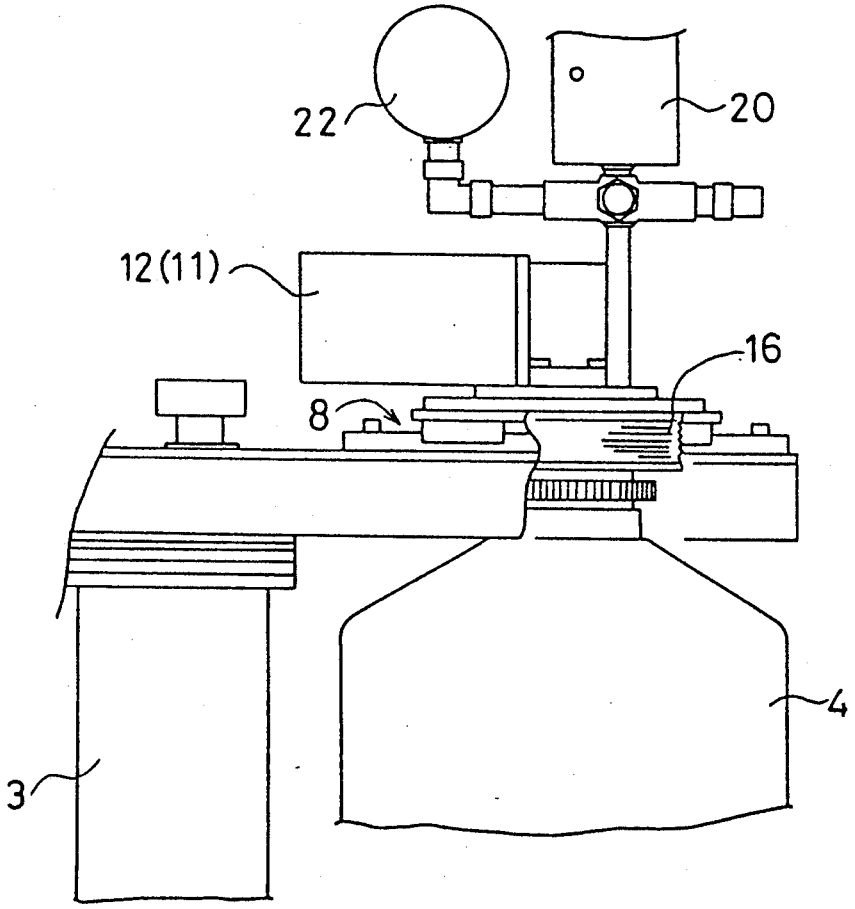
FIG. 4 is a main-part enlarged view showing the support structure of the liquefied gas reservoir.
Figure 5:
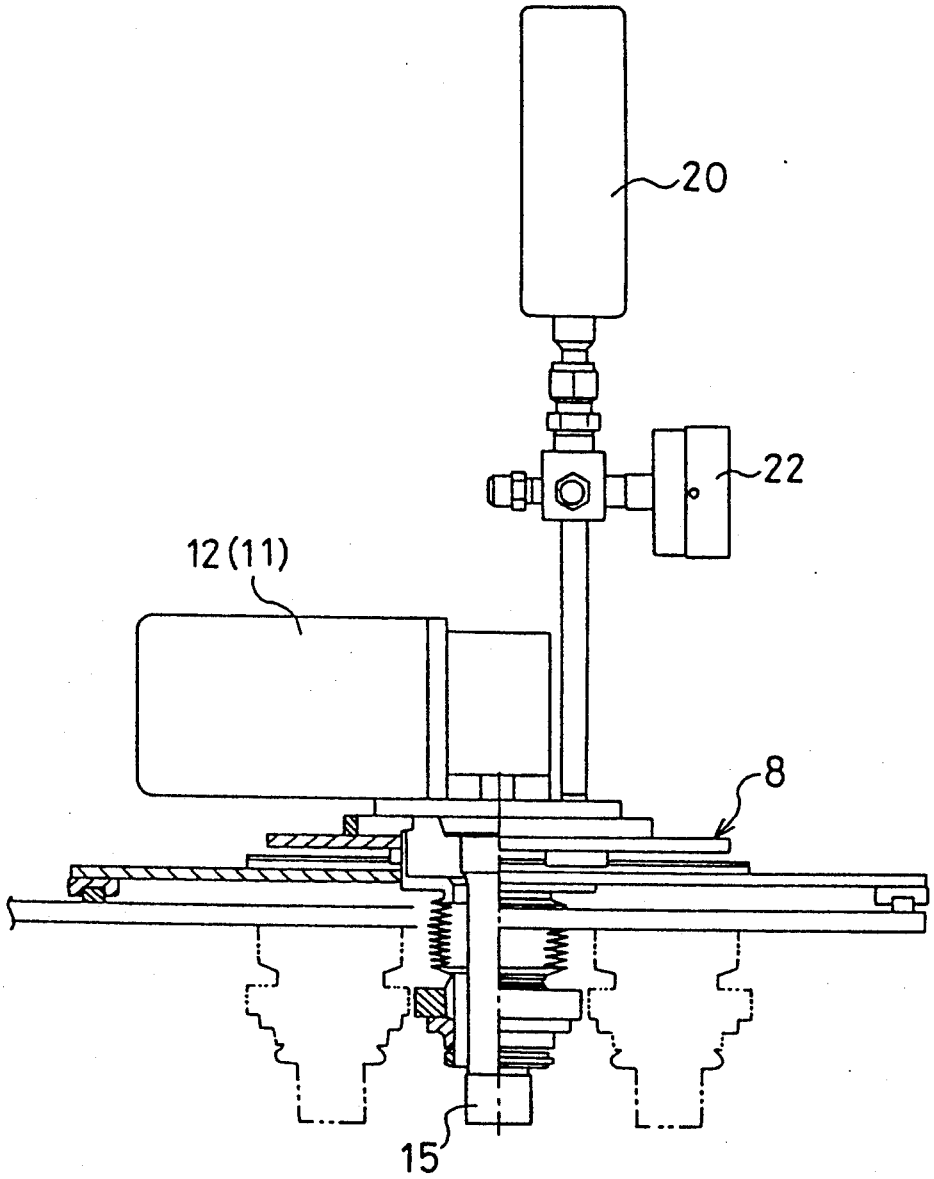
FIG. 5 is a partially broken view showing the support structure of the cold head.

Referring now to the flow chart shown in FIG. 1, the procedure for controlling operation of the cryogenic refrigerator 11 provided at the liquefied gas reservoir 4 will be described below.

Turning on the main switch causes the operation control device 19, level gauge 20, and temperature indicator 18 to be actuated, and when the level gauge 20 detects that the level of liquid nitrogen inside the liquefied gas reservoir 4 is below the lower limit, the notification lamp for liquid level will light.

Then, the operation switch of the cryogenic refrigerator 11 is handled (step S1). Subsequently, it is decided whether or not the atmospheric temperature inside the liquefied gas reservoir 4 detected by the temperature measuring instrument 17 is not less than 71 K. (step S2). If the temperature is decided to be not less than 71 K., the cryogenic refrigerator 11 is actuated (step S3). It is decided whether the cryogenic refrigerator 11 is normally operating or not (step S4); if it is, the cryogenic refrigerator 11 is continuously operated until the atmospheric temperature inside the liquefied gas reservoir 4 reaches 70 K. (step S5); when it reaches 70 K., the operation of the cryogenic refrigerator 11 is stopped (step S6), which is followed by return to step S2. If the cryogenic refrigerator 11 is decided to be not normally operating at step S4, refrigerator operation emergency indication will be made (step S7).

For use of the electron microscope, the automatic operation release switch is handled with the atmospheric temperature inside the liquefied gas reservoir 4 kept below 71 K. to effect the automatic operation released mode, which is followed by the standby state (step S8). This ensures that the cryogenic refrigerator 11 will not be operated during operation of the electron microscope even if the atmospheric temperature inside the liquefied gas reservoir 4 increases over 71 K., allowing measurement work with the electron microscope to be performed without being affected by vibrations involved in the operation of the cryogenic refrigerator. When the atmospheric temperature inside the liquefied gas reservoir 4 reaches 76.5 K. (step S9), a previous alarm for forced operation by means of a buzzer will be issued (step S10) and simultaneously the notification lamp be lighted (step S11). When an operator effects alarm release operation (step S12), the previous alarm for forced operation will stop (step S13). Thereafter, when the atmospheric temperature inside the liquefied gas reservoir 4 reaches 77 K., the standby state will be left (step S14), causing the notification lamp to go out (step S15) and step S3 in the automatic operation control mode starts, whereby the cryogenic refrigerator 11 is put into operation with the atmospheric temperature inside the liquefied gas reservoir 4 kept between 70 K. and 71 K. In addition, if the measurement work with the electron microscope is completed before the atmospheric temperature inside the liquefied gas reservoir 4 reaches 76.5 K., the standby state can forcedly be terminated by operating the reset switch (step S16) to operate the cryogenic refrigerator 11 with the atmospheric temperature inside the liquefied gas reservoir 4 kept between 70 K. and 71 K.

Although the bellows 16 is used as a vibration preventing support device in the above-described embodiment, the cold head 12 may be disposed preventively of vibrations and supported in the counter-balance method, or done by intervening some cushioning material such as vibration-proof rubber between the cold head 12 and the liquefied gas reservoir 4.

Although the present invention has been fully described by way of example with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. A method for preventing evaporation of liquefied gas in a liquefied gas reservoir, said liquefied gas reservoir comprising a cryogenic refrigerator with a cold head positioned at an upper end of the reservoir, said method comprising the steps of:

condensing and liquefying a vapor inside the liquefied gas reservoir, said step of condensing and liquefying being accomplished by having a cold end of the cold head extend into the upper end of the liquefied gas reservoir;

automatically controlling the cold head of the cryogenic refrigerator, such that said cryogenic refrigerator is automatically switched on when temperature inside said liquefied gas reservoir is above an automatic operation set temperature, and automatically switched off when said temperature reaches a predetermined low temperature;

activating an automatic operation release state when the temperature inside said liquefying gas reservoir is below said automatic operation set temperature, such that an energy dispersive spectrometer type x-ray can be placed into operation, with said x-ray being connected to a cold finger which extends from a container wall of said liquefied gas reservoir;

i) while said automatic operation is in the release state, sensing whether the temperature inside the reservoir has risen above the automatic operation set temperature, and triggering a switching alarm when the temperature reaches an alarm issuing temperature above said operation set temperature;

ii) forcibly switching back to the automatic control state when temperature inside the reservoir rises above the alarm issuing temperature and reaches a forced automatic operation state switching temperature;

(iii) resetting said switching alarm and switching operation; said method of resetting being remotely controllable.

2. A method as claimed in claim 1, wherein the automatic operation set temperature is set to 71 K.

3. A method as claimed in claim 1, wherein the alarm issuing temperature is set to 76.5 K.

4. A method as claimed in claim 1, wherein the forced automatic operation switching set temperature is set to 77 K.

5. A method for preventing evaporation of liquefied gas in a liquefied gas reservoir, said liquefied gas reservoir comprising a cryogenic refrigerator with a cold head positioned at an upper end of the reservoir said method comprising the steps of:

condensing and liquefying a vapor inside the liquefied gas reservoir;

automatically controlling the cold head of the cryogenic refrigerator, such that said cryogenic refrigerator is automatically switched on when temperature inside said liquefied gas reservoir is above an automatic operation set temperature, and automatically switched off when said temperature reaches a predetermined low temperature;

activating an automatic operation release state when the temperature inside said liquefying gas reservoir is below said automatic operation set temperature;

i) while said automatic operation is in the release state, sensing whether the temperature inside the reservoir has risen above the automatic operation set temperature, and triggering a switching alarm when the temperature reaches an alarm issuing temperature above said operation set temperature;

ii) forcibly switching back to the automatic control state when temperature inside the reservoir rises above the alarm issuing temperature and reaches a forced automatic operation state switching temperature;

(iii) resetting said switching alarm and switching operation; said method of resetting being remotely controllable.

* * * * *